US009620035B1

(12) United States Patent
Hochfelsen

(10) Patent No.: US 9,620,035 B1
(45) Date of Patent: Apr. 11, 2017

(54) VEHICLE PARKING SPACE SIGN SYSTEM

(71) Applicant: Jerrold J Hochfelsen, Plantation, FL (US)

(72) Inventor: Jerrold J Hochfelsen, Plantation, FL (US)

( * ) Notice: Subject to any disclaimer, the term of this patent is extended or adjusted under 35 U.S.C. 154(b) by 0 days.

(21) Appl. No.: 14/732,554

(22) Filed: Jun. 5, 2015

Related U.S. Application Data

(60) Provisional application No. 62/008,164, filed on Jun. 5, 2014.

(51) Int. Cl.

| | |
|---|---|
| ***E01F 9/00*** | (2016.01) |
| ***G09F 7/18*** | (2006.01) |
| ***G09F 7/00*** | (2006.01) |
| *E01F 9/017* | (2006.01) |

(52) U.S. Cl.
CPC ..... *G09F 7/18* (2013.01); *G09F 7/002* (2013.01); *E01F 9/017* (2013.01); *G09F 2007/1873* (2013.01)

(58) Field of Classification Search
CPC .... G09F 7/18; G09F 7/002; G09F 2007/1873; E01F 9/017
USPC ..... 404/10; 116/63 R, 200
See application file for complete search history.

(56) References Cited

U.S. PATENT DOCUMENTS 2,114,534 A * 4/1938 Johns ..... G07F 17/24 116/200
3,061,960 A * 11/1962 Dull ..... E01F 13/085 116/63 R
5,699,326 A * 12/1997 Haas ..... G04F 1/00 116/200
5,933,994 A * 8/1999 Misaresh ..... G09F 23/06 40/649
6,176,642 B1 * 1/2001 Hinterholzer ..... A63C 19/062 116/173
6,267,529 B1 * 7/2001 Mudryk ..... E01F 9/629 116/63 R
6,485,226 B1 * 11/2002 Harger ..... E01C 11/223 404/10
6,616,368 B2 * 9/2003 Birchler ..... E01F 13/02 256/13.1
6,945,731 B1 * 9/2005 Vait ..... G09F 17/00 116/173
7,186,054 B2 * 3/2007 Chambers ..... E01F 9/685 404/10
7,473,051 B2 * 1/2009 Audet ..... E01F 9/629 116/63 R
8,616,802 B2 * 12/2013 Gerrard ..... E01F 15/0461 256/13.1
2015/0154895 A1 * 6/2015 Cassidy ..... G09F 7/18 40/606.01

* cited by examiner

*Primary Examiner* — Raymond W Addie
(74) *Attorney, Agent, or Firm* — David P. Lhota, Esq.; Lhota & Associates, P.A.

(57) ABSTRACT

A parking space sign system that is placed in a parking space at the interior end and includes a U-shaped flexible bracket defining a base and two opposing arms projecting from the base, a pair of frame mounts adapted for mounting to the projecting arms, at least one sign panel having indicia thereon for placement in one of the frame mounts and an end cap for each end of each frame mount to secure the frame mounts to the flexible bracket. The flexible brackets are preferably made from a rubber-based material used for tires.

19 Claims, 4 Drawing Sheets

VEHICLE PARKING SPACE SIGN SYSTEM

CROSS-REFERENCE TO RELATED APPLICATION

This application claims the benefit of provisional patent application Ser. No. 62/008,164 filed Jun. 5, 2014.

STATEMENT REGARDING FEDERALLY SPONSORED RESEARCH OR DEVELOPMENT

N/A

INCORPORATION-BY-REFERENCE OF MATERIAL SUBMITTED ON A COMPACT DISK

N/A

FIELD OF THE INVENTION

This invention relates generally to a parking space sign system and more particularly, to a parking space sleeve system that mounts to a flexible support and displays interchangeable and, or illuminable advertising or sign panels.

BACKGROUND OF THE INVENTION

Parking spaces are known that do not have parking bumpers, yet it would be desirable and advantageous to be able to place signs or advertisements in these spaces. Attempts to provide signs in parking areas vary in design. For instance, there exists ground-mounted devices that do not have interchangeable signs and are rigid such that they could cause damage to a vehicle if hit or run over. There are also promotion distribution systems known that distribute promotions based on where a user has parked which allows merchants to target promotions remotely to where someone parks. Advertising devices and systems consisting of signs adhered to the road, parking space or on a wall also exist. Known devices such as these are either too complicated, susceptible to damage due to inclement weather, vehicle drips and animal droppings and are not easily interchangeable.

A variety of parking space sign systems are known in the background art. For instance, U.S. Pat. No. 8,250,795, issued to Barbieri et al., discloses a ground-mounted device for presenting a message consisting of a ground-mounted base, a cover and one or more panels. U.S. Pat. No. 3,820,065, issued to Koplewicz, discloses an electrically operated parking indicator having a hanging arm with a signaling means, such as a light bulb, that indicates the proper position of a vehicle being parked when the arm is actuated by vehicle causing the light bulb to illuminate. U.S. Pat. No. 3,621,807, issued to Kang, discloses an automobile parking guide in the shape of a stop sign that pivots and assists a driver in parking a vehicle in a garage so as to consistently leave the same space between the vehicle and a wall. U.S. Publication No. 2011/0270669 discloses a parking locator system having one or more parking sensors and one or more parking kiosks. U.S. Publication No. 2011/0015934 discloses parking promotion distribution system that distributes promotions based on where a user has parked and includes a one or more parking locators that detect the presence of a vehicle within a vicinity, a repository server and a kiosk for retrieving promotions. U.S. Publication No. 2010/0153311 discloses planar parking area advertising system having a portion of delineated portions that include a substantially planar advertising portion and is placed on the ground so the advertising is perpendicular to the pair of parallel parking lines and between opposing ends of the parking lines. U.S. Publication No. 2010/0131370 discloses a public and private road advertising system for ground surfaces that consists of a non-slip material affixed to a roadway surface. U.S. Publication No. 2008/0059296 discloses a method for providing parking location identifiers wherein advertisements are received from advertisers and placed within a parking area based on the theme advertising regions. U.S. Publication No. 2007/0063873 discloses an advertising standard consisting of a base, post and advertisement displaying surface. U.S. Publication No. 2005/0229451 discloses an apparatus for parking space advertising consisting of a sign and post. The foregoing parking space advertising devices and systems present the problems and shortcomings in the background art that the instant invention is intended to overcome.

Accordingly, existing devices and systems for advertising or placing signs in parking spaces do not adequately address or resolve the issues in the background art. Therefore, there exists a need for a parking space advertising or sign system that resolves these issues. It is, therefore, to the effective resolution of the aforementioned problems and shortcomings of the prior art that the present invention is directed. The instant invention addresses this unfulfilled need in the prior art by providing an advertising system for parking spaces as contemplated by the instant invention disclosed herein.

SUMMARY OF THE INVENTION

In light of the foregoing, it is an object of the present invention to provide a vehicle parking space sign system.

It is also an object of the instant invention to provide vehicle parking sign system that can be hit without causing damage to the vehicle.

It is another object of the instant invention to provide a parking space sign system that accommodates interchangeable signs.

It is an additional object of the instant invention to provide a parking space sign system that is not susceptible to damage caused by inclement weather, vehicle drips or animal droppings.

It is a further object of the instant invention to provide a parking space sign system that can be made with recyclable parts, such as tires, so as to be environmentally friendly.

It is yet another object of the instant invention to provide a parking space sign system that securely holds sign panels to prevent or minimize theft.

It is yet a further object of the instant invention to provide a parking space sign system that can provide signs for two opposing parking spaces.

It is yet an additional object of the instant invention to provide a parking space sign system that is cost effective.

In accordance with one aspect, the present invention provides a parking space sign system that is placed in a parking space and includes at least one flexible bracket, at least one frame mount and an end cap for each end of the frame mount. The flexible preferably comprises a rubber-based material. The frame mount defines a sleeve for receiving a sign panel having indicia thereon for conveying information. The end caps slide into opposite ends of the frame mount securing the panel therein. The end caps are affixed to the flexible bracket, such as with hardware, to support the frame mount on the flexible bracket so as to display the sign panel and indicia for presenting information to a driver parking a vehicle in the corresponding parking space. The flexible bracket may be L-shaped, J-shaped or U-shaped. The parking space sign system may include a light source and battery in one of the end caps so as to penetrate the sleeve and illuminate the frame mount and panel therein.

In another aspect, the present invention provides a parking space sign system that is placed in a parking space at the interior end and includes a U-shaped flexible bracket defining two opposing projecting arms, a pair of frame mounts adapted for mounting to the projecting arms, and an end cup for each end of each frame mount to secure the frame mounts to the flexible bracket. The flexible bracket preferably comprises a rubber-based material substantially similar to material used for tires. The frame mount has an upper flange and a lower flange that define a sleeve for removably receiving a sign panel having indicia thereon for conveying information. The end caps each include a plate that slide into opposite ends of the frame mount securing the panel therein, a lip that engages a corresponding end of a frame mount to limit penetration of the end cap into the sleeve and an elongated slotted aperture for aligning the end caps with the flexible brackets and receiving hardwire to secure the end caps and frame mounts to the flexible brackets in an elevated position to display the indicia to a driver parking a vehicle in the corresponding parking spate.

In an additional aspect, the present invention provides a parking space sign system that is placed in a parking space at the interior end and includes a U-shaped flexible bracket defining a base and two opposing arms projecting from the base, a pair of frame mounts adapted for mounting to the projecting arms, at least one sign panel having indicia thereon for placement in one of the frame mounts and an end cap for each end of each frame mount to secure the frame mounts to the flexible bracket. The flexible brackets are preferably made from a rubber-based material used for tires. The flexible brackets include at least one aperture in each arm for securing the frame mounts and an aperture in the base for receiving hardware used to secure the brackets to a ground surface. The frame mount has an upper flange and a lower flange that define a sleeve for removably receiving the sign panel displaying the indicia thereon. The end caps each include a plate that slide into opposite ends of the frame mount securing the panel therein, a lip that engages a corresponding end of a frame mount to limit penetration of the end cap into the sleeve and an elongated slotted aperture for aligning the end caps with the apertures in arms of the flexible brackets and receiving hardware to secure the end caps and frame mounts to the flexible brackets in an elevated position to display the indicia to a driver parking a vehicle in the corresponding parking space. The flanges may merge to define a rear wall and the sleeve.

In accordance with these and other objects, which will become apparent hereinafter, the instant invention will now be described with particular reference to the accompanying drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

With reference to the drawings, FIGS. 1-5 depict the preferred embodiment of the instant invention which is generally referenced as a vehicle parking space sign system, parking space sign system and, or by numeric character 10. The instant invention 10 comprises a stand-alone parking space sign system for displaying parking signs or advertisements in parking spaces without parking bumpers. The parking space sign system 10 displays the panels with a name, message or advertisement from within its structure so as to protect the panel from inclement weather, bird droppings, hot automobile liquid drippings and other elements that would damage and erode the signage. Displaying the panel from within the parking space sign system 10 also helps to present or minimize theft. The instant invention 10 is also designed to accommodate interchangeable panels. The parking advertising system 10 can also display names, messages or advertisements on a front surface and back surface to provide simultaneously signage for two opposing parking spaces. The instant invention 10 is also flexible to withstand being bumped or run over by a vehicle.

Figure 1:
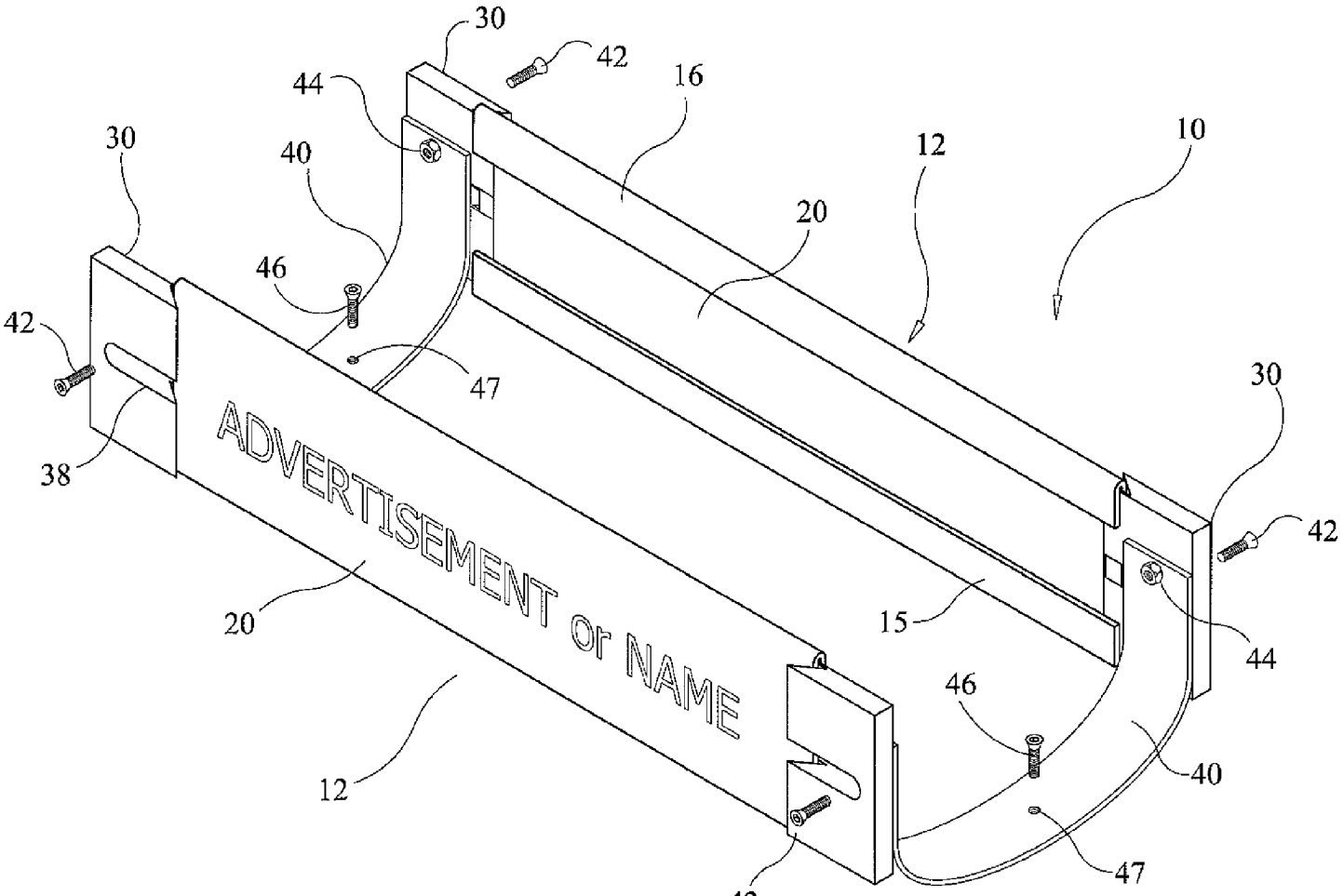
FIG. 1 is a perspective view of the parking space advertising system in accordance with the instant invention.

With reference to FIGS. 1-4, in the preferred embodiment of the instant invention the vehicle parking space sign system 10 comprises two flexible brackets 40, at least one and preferably two frame mounts 12 and an end cap 30 for each end of each frame mount 12. Referring to FIG. 1, the flexible brackets 40 preferably comprise a U-shaped rubber based material, similar to that found in tires, which can bend without breaking while storing potential energy went bent such that it returns to its original position when released. The U-shaped flexible brackets 40 may be reinforced with a bendable steel or other metal embedded in the rubber, as is known with conventional tires. The flexible brackets 40 may be made from tires. The rubber used for the flexible brackets 40 are also soft or pliable enough so as to not cause damage to a vehicle if it runs over the parking space sign system 10. The flexible brackets 40 may also be semi-rigid yet flexible.

Figure 2:
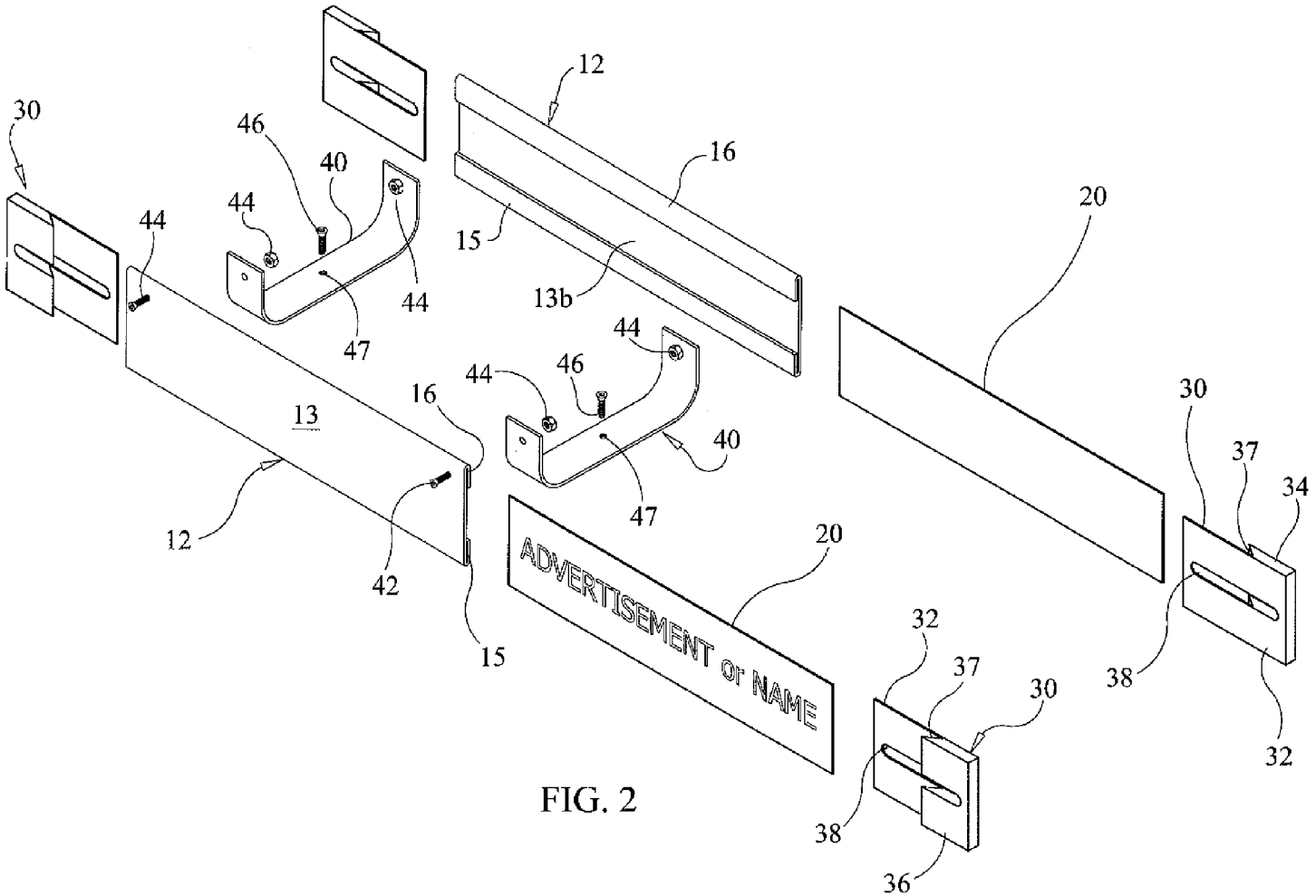
FIG. 2 is a perspective exploded view of the parking space advertising system in accordance with the instant invention.

With reference to FIGS. 1-2, the frame mount 12 has a lower upward projecting flange 15 and upper depending flange 16 wherein the lower flange 15 and upper flange 16 define a sleeve for receiving a sign panel 20, as shown in FIG. 1. The frame mount 12 and panel 20 assembly is mounted to the flexible brackets 40 using end caps 30, as shown in FIG. 1. Each end cap 30 comprises a flat plate 32 with a flange 34 projecting upward from the plate 32 and a lip 36 formed at the interior end of the flange 34 for catching the side of the frame mount 12. A slot 38 extends across the plate 32 and into the flange 34 for receiving a fastener, such as a screw or bolt, and lining it up with an aperture in the frame mount 12 and bracket 40. The lip 36 defines a recessed groove 37 for receiving the edge of the frame mount 12, as shown in FIG. 1. The sign panel 20 displaying the name, message or advertisement, slides into the sleeve of the frame mount 12 formed by flanges 15, 16. An end cap 30 is inserted into each end of the frame mount 12 into the frame sleeve creating a friction fit that secures the sign panel 20 in the frame mount 12 while sealing off the end of the frame mount 12 from moisture. The frame mount 12 is attached to a bracket 40 by passing a threaded fastener 42, such as a screw or bolt, through the slotted aperture 38 of the end cap and a corresponding aperture in the flexible bracket 40 and securing it to the bracket 40 with a corresponding threaded fastener, such as a nut 44. The fasteners 42, 44 may not be threaded in an alternative embodiment.

With reference to FIG. 2, the panel 20 is interchangeable wherein the panel 20 can be removed and replaced with a new panel 20 at any time. To replace a panel 20, the parking space sign system 10 is first detached from the U-bracket 40 by removing the fasteners 42 and 44. Then at least one end cap 30 is removed from the frame mount 12. Due to the friction fit provided by the end caps 30, both end caps 30 may have to be removed to release the panel 20. Once one or both end cups 30 are removed, the panel 20 is simply slid out from the sleeve formed by the frame mount 12. A new panel 20 is then slid into the sleeve of the frame mount 12 and then secured in place by reinserting the end caps 30.

Figure 3:
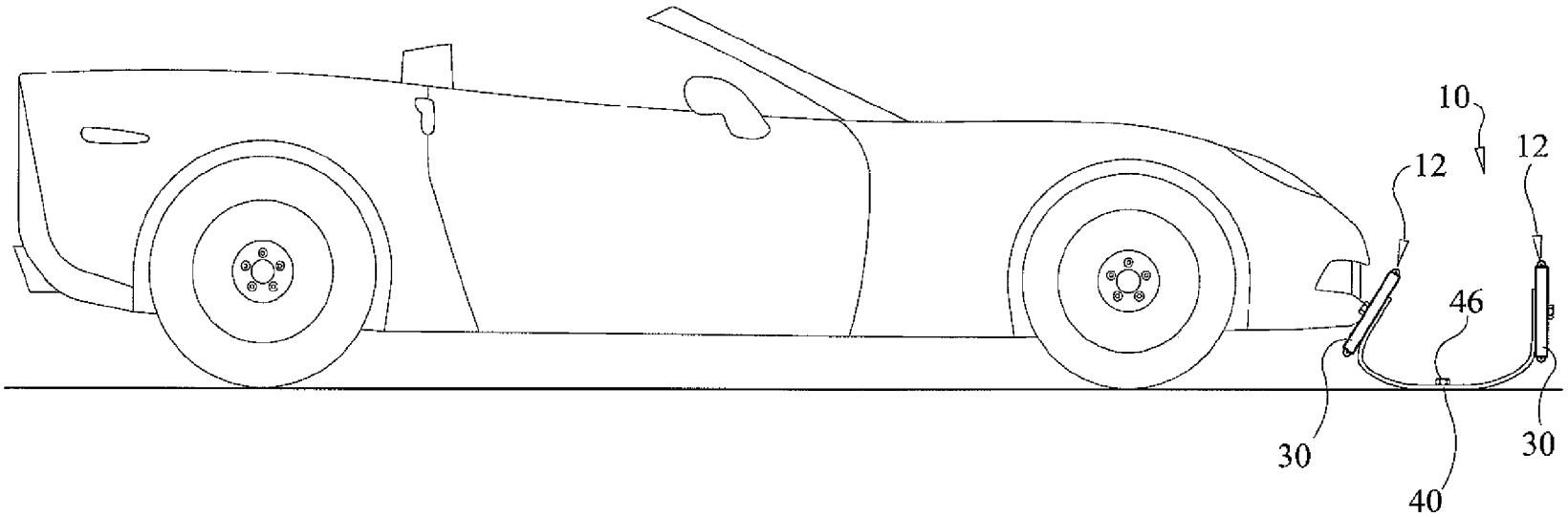
FIG. 3 is a side elevational view of the parking space advertising system in accordance with the instant invention.

With reference to FIG. 3, the parking space sign system 10 is secured in a parking space by securing the brackets 40 to the parking space surface. The bracket 40 is secured to a parking space ground surface, such as concrete or asphalt, with a preferred fastener 46 adapted for concrete or asphalt, such as those sold under the trademark Tapcon®, that is passed through an aperture 47 in the base of the bracket 40 directly into the surface or into a predrilled hole in the surface. Alternatively, an anchor may be placed in the hole drilled in the ground surface for receiving the fastener 46. As can be seen in FIG. 3, the parking space sign system 10 is flexible and provides a sign on both sides to provide signage for opposite parking spaces facing each other. The flexibility of the park space sign system 10 is also shown in FIG. 3, where a vehicle is shown deflecting the brackets 40. This method of securing the sign system 10 to a ground surface allows for convenient movement or replacing the sign system 10.

Figure 4:
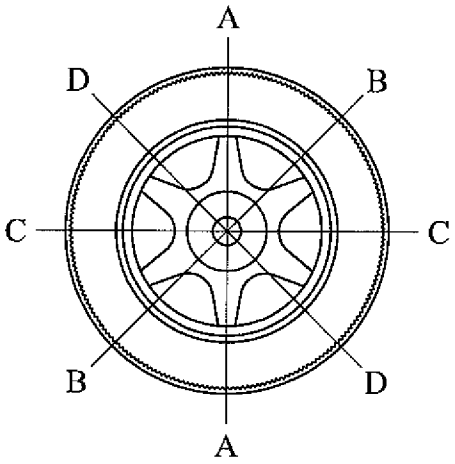
FIG. 4 is a plan view of cut lines on a tire for use in the parking space advertising system in accordance with the instant invention.

With reference to FIG. 4, the U-brackets 40 are preferably made from a tire. However, the U-brackets 40 may also be molded from flexible rubber or rubber-like material. The U-brackets 40 are made by making a plurality of diagonal cuts, such as along lines A-A to D-D, through the tire as it is positioned horizontally on a flat support surface. The number of diagonal cuts may be decreased or increased to increase and decrease the size of the brackets 40, as shown in FIG. 4. Once all the cuts have been made, there exists a plurality of U-shaped brackets 40.

Figure 5:
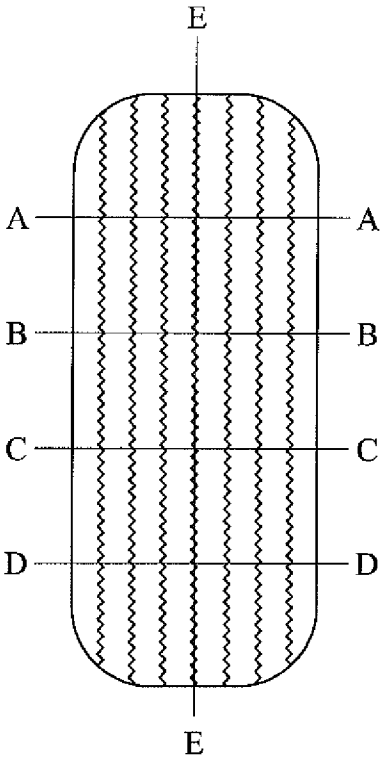
FIG. 5 is an elevational view of cut lines on a tire for use in the parking space advertising system in accordance with the instant invention.

With reference to FIG. 5, in an alternative embodiment the bracket 40 may comprises an L-shaped or J-shaped bracket wherein the U-shaped bracket is cut in half by making a vertical cut along lines E-E of the tire. The L-shaped or U-shaped bracket made by cutting the U-shaped bracket 40 in half may be used for presenting a sign in a single parking space, such as those against a wall, rather than two opposing parking spaces. Once all the cuts have been made, there exists a plurality of L-shaped or J-shaped brackets.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A vehicle parking space sign system, said system comprising:
- at least one flexible U-shaped bracket;
- at least one frame mount, said frame mount defining an open-ended sleeve;
- at least one end cap adapted for sliding into said open-ended sleeve; and
- means for mounting said end cap and said frame mount to said flexible bracket.

2. The system of claim 1, wherein said means for mounting comprises:
- hardware for penetrating said end cap and said flexible bracket to support said frame mount on said flexible bracket.

3. The system of claim 1, further comprising:
- a bracket aperture defined by said flexible bracket;
- an aperture defined by said end cap; and
- a first threaded fastener for inserting through said bracket aperture and said end cap aperture and a second threaded fastener for mating with said first threaded aperture.

4. The system of claim 3, wherein said end cap aperture is an elongated aperture.

5. The system of claim 1, further comprising a panel adapted for slidably engaging said sleeve, said panel having indicia thereon.

6. The system of claim 1, wherein said flexible bracket has a base and an arm projecting upward from said base.

7. The system of claim 1, wherein said flexible bracket has a base, a first arm projecting upward from said base and a second arm projecting upward from said base.

8. The system of claim 7, further comprising:
- a second frame mount having an open ended sleeve;
- said at least one frame being adapted for mounting to said first arm; and
- said second frame mount being adapted for mounting to said second arm.

9. The system of claim 1, wherein said at least one end cap further comprises a light source and battery configured to illuminate said at least one frame mount.

10. A vehicle parking space sign system, said system comprising:
- a first flexible bracket;
- a second flexible bracket;
- at least one frame mount, said frame mount having an upper flange depending from an upper end and a lower flange projecting upward, an open-ended sleeve defined by said upper flange and said lower flange, said frame mount having a first open end and a second open end in communication with said sleeve;
- a first end cap adapted for sliding into said open-ended sleeve through said first open end;
- a second end cap adapted for sliding into said open-ended sleeve through said second open end; and
- means for mounting said end caps and said frame mount to said flexible brackets.

11. The system of claim 10, further comprising:
- said first flexible bracket comprising a first base and a first arm projecting upward from said first base and said second flexible bracket comprises a second base and a second arm projecting upward from said second base; and said first end cap being adapted for mounting to said first arm and said second end cap being adapted for mounting to said second arm.

12. The system of claim 10, further comprising:

said first flexible bracket comprising a first base and a first front arm projecting upward from said first base and a first rear arm projecting upward from said first base;

said second flexible bracket comprising a second base and a second front arm projecting upward from said second base and a second rear arm projecting upward from said second base;

a second frame mount having second upper flange depending from an upper end and a second lower flange projecting upward, a second open-ended sleeve defined by said second upper flange and said second lower flange, said second frame mount having a left open end and a right open end in communication with said second sleeve;

a third end cap with an aperture adapted for sliding into said left open end;

a fourth end cap with an aperture adapted for sliding into said right open end;

said first front cap being adapted for mounting to said first arm;

said second end cap being adapted for mounting to said second front arm;

said third end cap being adapted for mounting to said first rear arm; and said fourth end cap being adapted for mounting to said second rear arm.

13. The system of claim 12, wherein said means for mounting comprises:

first hardwire for penetrating said first front end cap and said first arm;

second hardware for penetrating said second end cap and said second front arm;

third hardware for penetrating said third end cap and said first rear arm; and fourth hardware for penetrating said fourth end cap and said second rear arm.

14. The system of claim 13, wherein said first end cap has a first aperture for receiving said first hardware, said second end cap has a second aperture for receiving said second hardware, said third end cap has a third hardware for receiving said third aperture and said fourth end cap has a fourth aperture for receiving said fourth hardware.

15. The system of claim 14, wherein said first end cap aperture, said second end cap aperture, said third end cap aperture and said fourth end cap aperture are elongated for adjusting said end caps on said flexible brackets.

16. The system of claim 10, wherein:

said first flexible bracket and said second flexible bracket comprising a flexible and semi-rigid rubber.

17. The system of claim 10, wherein said first flexible bracket and said second flexible bracket comprise a tire material.

18. The system of claim 10, wherein said first flexible bracket and said second flexible bracket are reinforced by metal.

19. The system of claim 10, wherein the at least one end cap further comprises a light source and battery configured to illuminate the at least one frame mount.

* * * * *